United States Patent [19]

Wu

[11] Patent Number: 4,727,230

[45] Date of Patent: Feb. 23, 1988

[54] SAFETY SWITCH FOR INDUCTIVELY DRIVEN ELECTROMAGNETIC PROJECTILE LAUNCHERS

[75] Inventor: Jiing-Liang Wu, Murrysville Borough, Pa.

[73] Assignee: Westinghouse Electric Corp., Pittsburgh, Pa.

[21] Appl. No.: 2,062

[22] Filed: Jan. 9, 1987

[51] Int. Cl.[4] ..... H01H 33/06; H01H 9/32

[52] U.S. Cl. ..... 200/151; 200/144 R; 89/8

[58] Field of Search ..... 200/151, 144 R

[56] References Cited

U.S. PATENT DOCUMENTS

| | | | |
|---|---|---|---|
| 4,369,692 | 1/1983 | Kemeny | 89/8 |
| 4,426,562 | 1/1984 | Kemeny | 200/151 |
| 4,433,607 | 2/1984 | Kemeny | 89/8 |
| 4,534,263 | 8/1985 | Heyne et al. | 89/8 |
| 4,572,933 | 2/1986 | Swanson | 200/151 |

OTHER PUBLICATIONS

P. Wildi et al., "High Current Switches in the Doublet III Poloidal Field Circuit", Proceedings of the Seventh Symposium on Engineering Problems of Fusion Research, IEEE Pub. No. 77C17 1267-4-NP, pp. 1753-1756, 1977.

*Primary Examiner*—Robert S. Macon
*Attorney, Agent, or Firm*—D. Schron

[57] ABSTRACT

A safety switch for use in an inductively driven electromagnetic launcher system includes three tubular conductors each having a substantially cylindrical internal surface, wherein these internal surfaces have substantially the same internal diameter and are positioned at spaced locations along a common axis. A fourth tubular conductor having a cylindrical external surface with a diameter which is substantially equal to the internal diameters of the first three conductors. This fourth conductor is mounted for movement along the common axis such that its external surface is capable of making sliding electrical contact with the internal surfaces of the first three conductors. The external surface of the fourth conductors has sufficient axial length to be capable of making electrical contact with each of the internal surfaces simultaneously. Means are provided for electrically connecting the first three tubular conductors to an external circuit and a switch actuating means serves to move the fourth tubular conductor axially along the common axis.

7 Claims, 7 Drawing Figures

SAFETY SWITCH FOR INDUCTIVELY DRIVEN ELECTROMAGNETIC PROJECTILE LAUNCHERS

STATEMENT OF GOVERNMENT INTEREST

The United States Government has rights in this invention pursuant to Contract No. F08635-84-C-0331 awarded by the Department of Defense.

BACKGROUND OF THE INVENTION

This invention relates to electric switches and more particularly to such switches which are used to switch very large direct currents as are found in electromagnetic projectile launching systems.

One well-known type of electromagnetic projectile launching system includes a power supply which comprises the series connection of a direct current homopolar generator and an inductive energy storage device. This power supply is connected to the breech ends of a pair of generally parallel projectile launching rails and a firing switch is connected to short across the breech ends of the rails. In operation, the rotor of the homopolar generator is spun up to a desired speed before its brushes are dropped. With the firing switch in a closed position, the generator brushes are dropped and current flow is established through the inductor. Thus, part of the generator energy is transferred to the inductor. Subsequently, the firing switch commutates current into the projectile launching rails and through a sliding armature positioned between the rails to place a high acceleration force on an associated projectile.

Certain abnormal conditions may result in an undesirable effect wherein a voltage reversal appears across the generator terminals. This may cause the generator to rotate in the reverse direction. Furthermore, other possible component malfunctions may occur such as the failure of the firing switch to open on command. Under such conditions, the energy stored in the homopolar generator must be dissipated within the inductor-charging loop, which includes the homopolar generator brushes. This may create mechanical problems such as excessive brush wear as well as thermal heating of the components.

One proposed solution to these problems is to include two switches, a crowbar switch and a dump switch, in the system. The crowbar switch, which is normally open, is connected in parallel with the homopolar generator-inductor assembly and upon actuation provides a by-pass for current which normally flows through the firing switch or through the launcher rails. This prevents overheating of the firing switch and the launcher rails under abnormal conditions. The dump switch is connected in series with the homopolar generator, is normally closed, and has a dump resistor connected across its terminals. The opening of the dump switch would force current to flow through the dump resistor, thus dissipating energy stored in the homopolar generator and the inductor.

To minimize damage, it is preferred to activate simultaneously with the crowbarring or following it immediately, the dump switch so that an electric arc is generated. The arc voltage then can force the current to flow through the dump resistor, thereby starting energy dissipation. To have an optimum performance in energy dissipation and to prevent generator voltage reversal, a fast-acting switch mechanism with low jitter and precise coordination of actuation between the crowbar and dump switches is required. It is therefore desirable to develop a simpler system which can protect the homopolar generator and other components from unacceptably high resistive heating while preventing voltage reversal across the generator terminals.

SUMMARY OF THE INVENTION

The present invention comprises a three-terminal switch which is applicable to homopolar generator powered, inductively driven, rail gun systems. The switch employs a coaxial arrangement of switch conductors which results in a compact, low inductance, and electromagnetic force balanced switch. Such a switch can be advantageously used in a rail gun system to protect a homopolar generator from system voltage transients, overheating and voltage reversal under normal or abnormal operating conditions.

An electric switch constructed in accordance with this invention comprises three tubular conductors each having a substantially cylindrical internal surface, wherein the internal surfaces have substantially the same internal diameter and are positioned at spaced locations along a common axis. A fourth tubular conductor having a cylindrical external surface with a diameter which is substantially equal to the internal diameter of the cylindrical internal surfaces of the three conductors is mounted to slide along the common axis such that this external surface is capable of making sliding electrical contact with the cylindrical internal surfaces of the three conductors and the external surface has sufficient axial length to be capable of making electrical contact with each of the internal surfaces simultaneously. Means for moving the fourth conductor axially with respect to the first three conductors and means for connecting the first three conductors to an external circuit are also provided.

A resistor is electrically connected across two of the first three tubular conductors and preferably comprises a tubular structure which is mounted along the common axis and positioned outside of at least one of the tubular conductors.

DESCRIPTION OF THE PREFERRED EMBODIMENT

Figure 1:
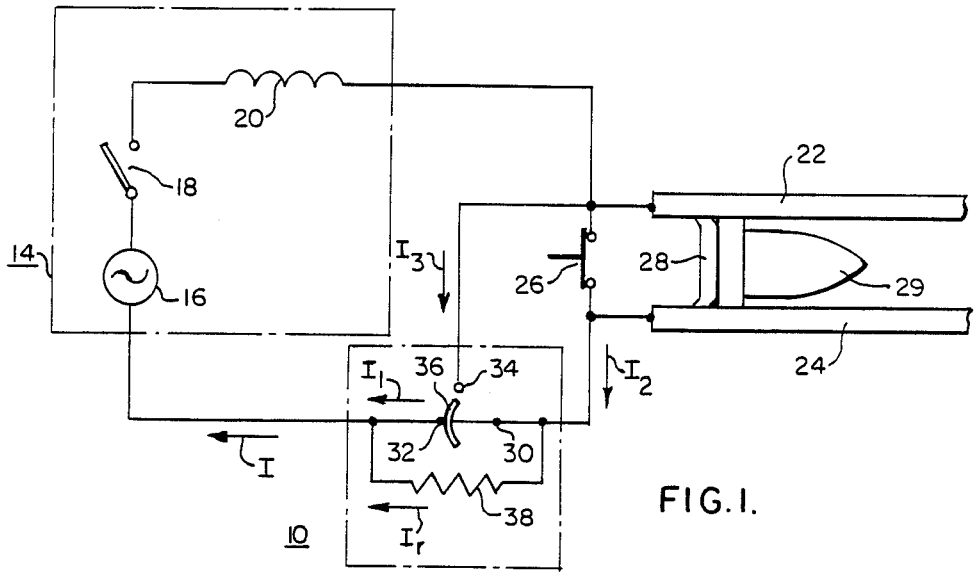
FIG. 1 is a schematic diagram of an electromagnetic projectile launching system which includes a safety switch constructed in accordance with the present invention.

Referring to the drawings, FIG. 1 is a schematic diagram of an inductively driven electromagnetic projectile launching system having a safety switch 10 constructed in accordance with the present invention. The system power supply 14 includes the series connection of a homopolar generator 16, a switch 18 (which may be the homopolar generator brushes), and an inductive energy storage device 20. This power supply is connected through switch 10 to the breech ends of a pair of generally parallel, conductive projectile launching rails 22 and 24. A firing switch 26 is connected to short across the breech ends of the projectile launching rails so that with the safety switch 10 in the position shown, opening of the firing switch commutates current into the rails and through a sliding conductive armature 28, thereby producing an electromagnetic accelerating force on the armature and its associated projectile 29.

The safety switch includes a first terminal 30 connected to projectile launching rail 24, a second terminal 32 connected to the homopolar generator, and a third terminal 34 connected to the inductive energy storage device. A movable contact 36 is positioned to provide an electrical connection between terminal 30 and terminals 32 and 34 and is of sufficient length so that the connection between terminals 30 and 34 is made before the connection between terminals 30 and 32 is broken. An energy-absorbing dump resitor 38 is connected across switch terminals 30 and 32 and serves to dissipate circuit energy following actuation of the switch. Various circuit currents are designated by the letter I with appropriate subscripts in FIGS. 1–5.

Figure 2:
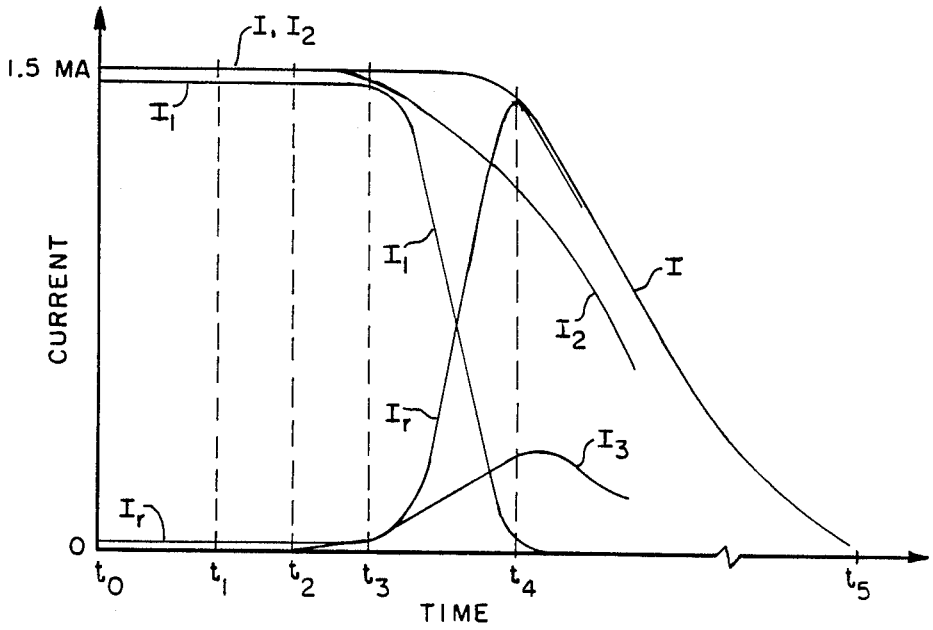
FIG. 2 is a series of curves which illustrate the flow of currents in the launcher system of FIG. 1.

Under normal operating conditions, the movable contact 36 of the safety switch 10 is initially in the position shown in FIG. 1, allowing the inductive storage coil to be charged by the generator with the firing switch in the closed position. After the desired coil-charging current, I, has been reached, which may be for example 1.5 mega-amps as shown in FIG. 2, the firing switch 26 is opened, thereby commutating current from the power source into the projectile launching rails. Just prior to projectile exit from the muzzle, the safety switch can be actuated in accordance with the time sequence shown in FIG. 2. At time $t_1$ in FIG. 2, contact 36 in switch 10 begins to move, such that at time $t_2$ terminals 30, 32 and 34 are all shorted together. At time $t_3$ contact 36 breaks from contact 32 and arcing occurs between contact 36 and terminal 32 from time $t_3$ to time $t_4$, thereby transferring current into the resistor. Thus, the energy remaining in the homopolar generator and the inductor is dissipated in the resistor 38 following the exit of the projectile.

The safety switch 10 can also be used to dump the homopolar generator energy under abnormal conditions such as when the firing switch 26 fails to open on command. If this condition is detected during the coil-charging phase, actuation of the safety switch would then dump the homopolar generator energy and the inductor energy into resistor 38.

Figure 3:
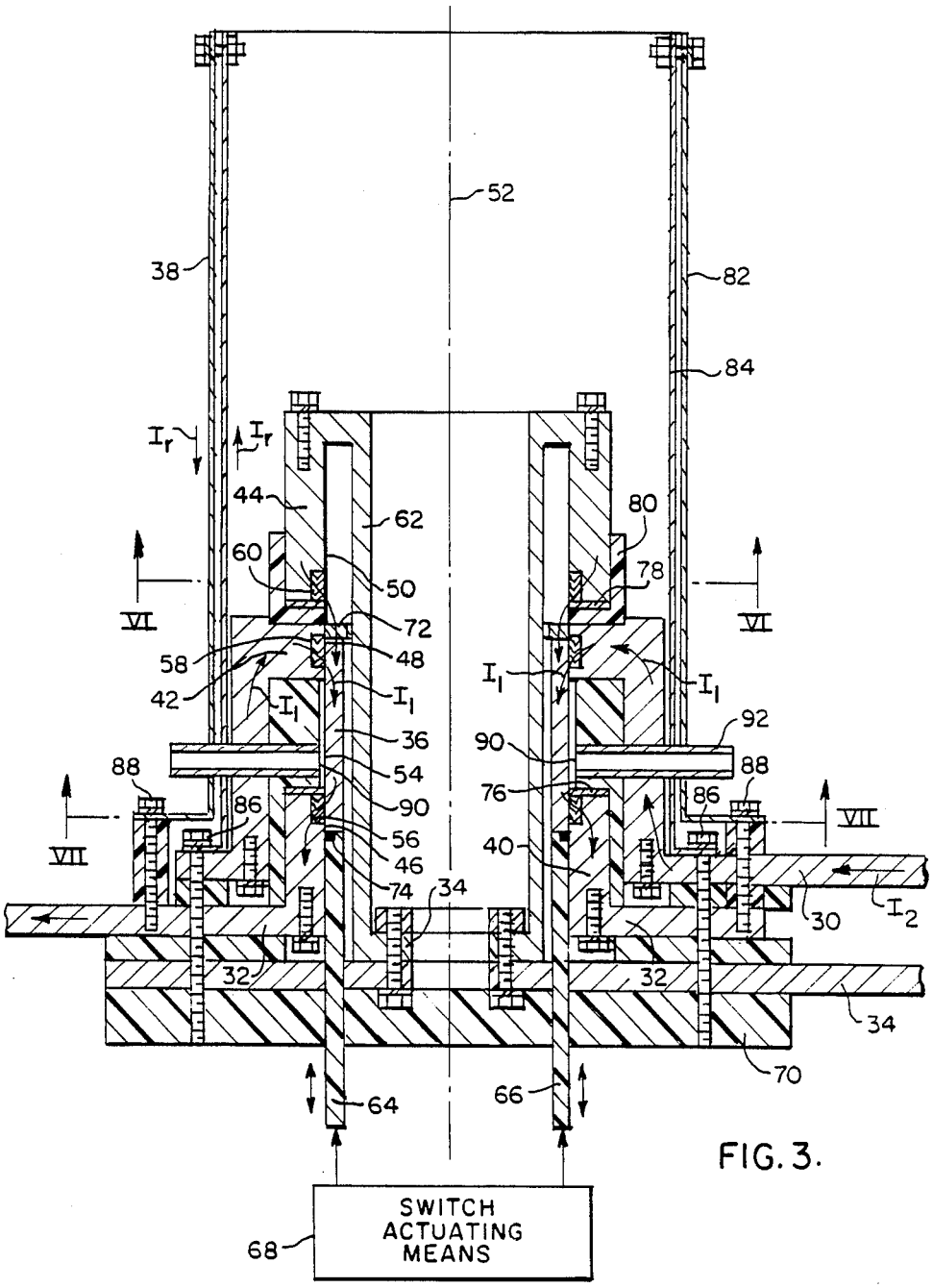
FIGS. 3, 4 and 5 are cross sections of a switch connected in accordance with one embodiment of this invention with the shorting conductor shown at various positions.

FIG. 3 is a cross section of the switch 10 in FIG. 1 with the movable contact 36 in the position shown in FIG. 1. The switch is constructed of three tubular conductors 40, 42 and 44, each having a substantially cylindrical internal surface 46, 48 and 50, wherein these internal surfaces have substantially the same diameter and are positioned at spaced locations along a common axis 52. Contact 36 represents a fourth tubular conductor having a cylindrical external surface 54 with a diameter which is substantially equal to the diameter of the internal surfaces of conductors 40, 42 and 44. This fourth tubular conductor is mounted along the same common axis and is positioned to be capable of making sliding electrical contact with the cylindrical internal surfaces of conductors 40, 42 and 44. The tubular conductive contact 36 has sufficient axial length such that it is capable of making electrical contact with conductors 40, 42 and 44 simultaneously.

Each of the stationary tubular conductors has a ring of current transfer contacts 56, 58 and 60 which may be brushes, multiple leaf contact plates, or other structures which perform the same function. Tubular conductor 40 is connected to terminal 32, tubular conductor 42 is connected to terminal 30, and tubular conductor 44 is connected via an internal tube 62 to terminal 34, thereby achieving a coaxial current flow configuration for the purpose of minimizing switch inductance and for mechanical strength reasons.

A pair of insulated operating rods 64 and 66 are connected to the movable tubular conductive contact 36 to move that contact axially along the common axis when driven by switch actuating means 68. The operating mechanism of this actuating means may be similar to that used in puffer-type circuit breakers. These operating rods extend through an insulating switch base 70 which also serves as a mounting base for the bus bars which are connected to terminals 30, 32 and 34. When the movable contact 36 is in the position shown in FIG. 3, it is shorting out conductors 40 and 42 and the switch is in the position shown schematically in FIG. 1. As the movable contact moves upward, it initially reaches a point where all three tubular contacts 40, 42 and 44 are shorted together. This is achieved by designing contact 36 to have a sufficient length such that electrical connection is made between conductor 44 and contact 36 before electrical contact is broken between conductor 40 and contact 36. In both the making and breaking processes, arcing can be expected. Therefore, arc-resistant material such as copper tungsten materials 72 and 74, are positioned at ends of the movable contact 36 as shown. Similarly, arc-resistant materials 76 and 78 are also located at the ends of conductors 40 and 44, respectively. Arc chambers 90 are formed between insulator 80 and the external surface of contact 36. The arc chambers extend longitudinally from conductor 42 to the location of arc-resistant material 76. Adjacent to and concentric with the insulating structure 80, a cylindrically-shaped dump resistor 38, which comprises two coaxial cylinders 82 and 84, is connected across terminals 30 and 32. Resistor cylinder 84 is connected by way of bolts 86 to tubular conductor 42 and terminal 30 while cylindrical-resistive element 82 is connected by way of bolts 88 to terminal 32 and tubular conductor 40. Vent tubes 92 are connected to the arc chambers 90 to provide passages for venting of arc products.

Figure 4:
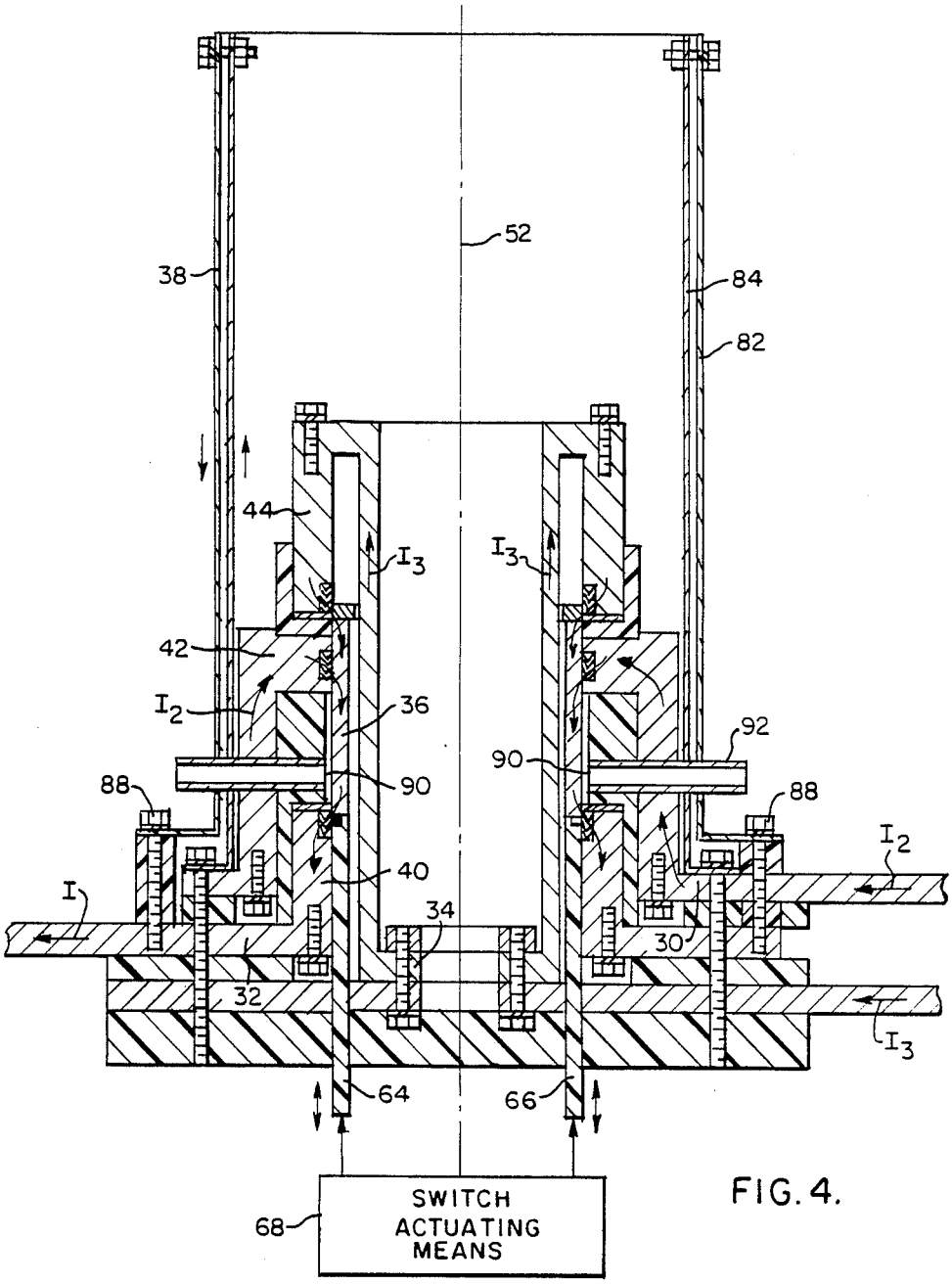
Figure 5:
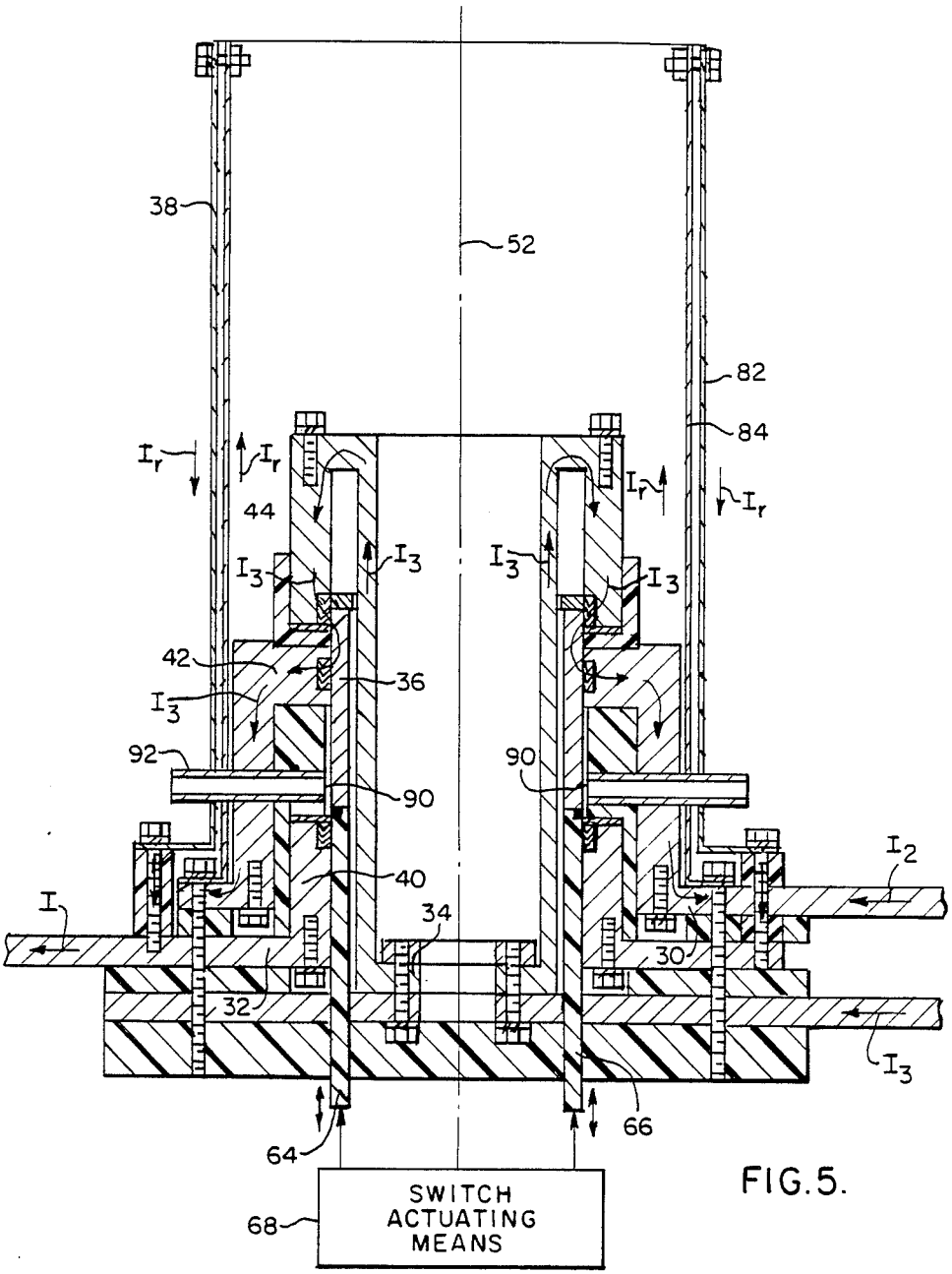

In FIGS. 3, 4 and 5, the arrows represent the currents illustrated in FIG. 1. FIG. 4 illustrates the switch as it appears between times $t_2$ and $t_3$ in FIG. 2. Here, the movable tubular contact 36 has moved upward until it bridges tubular conductors 40, 42 and 44. Current $I_3$ begins to flow as soon as contact 36 makes an electrical connection with tubular conductor 44. FIG. 5 illustrates the switch after movable tubular contact 36 has broken contact with tubular conductor 40. This occurs following time $t_4$ in FIG. 2. Note that current $I_1$ is no longer present.

Figure 6:
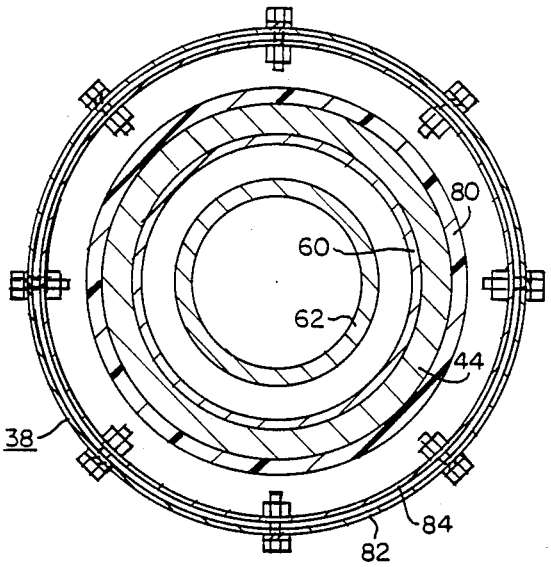
FIG. 6 is a cross section of the switch of FIG. 3 taken along line VI—VI.
Figure 7:
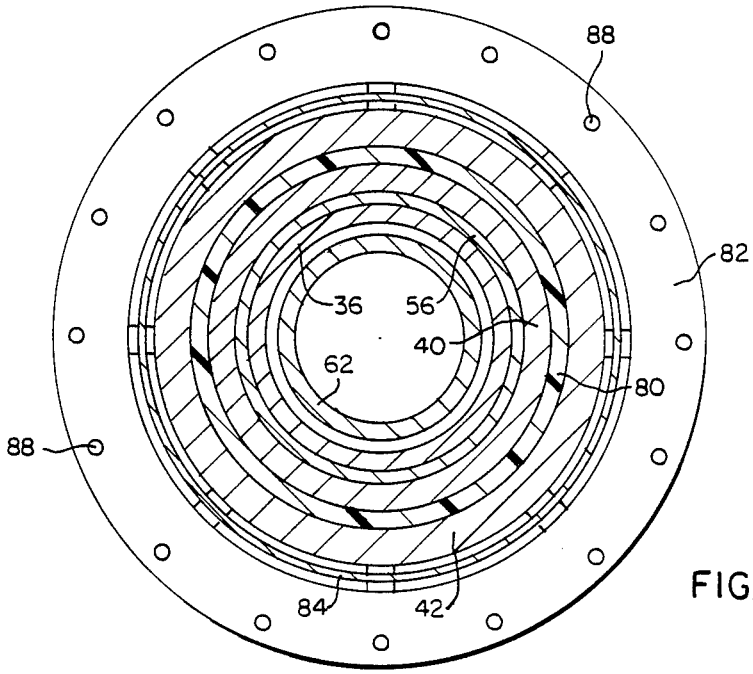
FIG. 7 is a cross section of the switch of FIG. 3 taken along line VII—VII.

FIGS. 6 and 7 are cross-sectional views of the switch of FIG. 3 taken along lines VI—VI and VII—VII, respectively. These figures are included to further illustrate the cylindrical nature of the conductive, resistive and insulating elements of the present invention switch assembly.

The switch of FIGS. 3–7 has been designed to have a resistance in the charging phase of about 1.9 micro-ohms, which includes a bulk resistance of about 1 micro-ohm, four sliding contact interface resistances of about 0.13 micro-ohm each, and four bolted joint interface resistances of about 0.1 micro-ohm each. The switch inductance in the charging phase would be about 21 nonohenrys, and the dump resistor resistance would be about 240 micro-ohms. The speed of the sliding tubular contact 36 would be about 10 meters per second.

In preparation for charging the inductor 20 in FIG. 1, the switch is in the position indicated in FIG. 3. In moving to this position, a contact opening spring within the switch actuating means would be charged. The switch actuating means is thus ready to actuate the switch to the position illustrated in FIG. 5 at any instant. After the movable contact 36 is latched in the position of FIG. 3, current flow can be initiated by dropping the brushes of the homopolar generator. The coaxial configuration of the current path in the switch not only minimizes switch inductance, but also substantially reduces the mechanical strength requirements of the switch structure.

When the switch is commanded to operate, the movable switch contact 36 is actuated to move upward. After a short travel, the contact bridges the three tubular conductors 40, 42 and 44 as shown in FIG. 4. Then, the moving contact 36 breaks contact with the conductor 40 and an arc is generated. As the arc length and arc voltage increase, homopolar generator current and current from the launcher is forced to flow through the resistor. After a certain time, the residual energy in the homopolar generator and the inductor is dissipated by the resistor.

It should be apparent from the above discussion that the safety switch of the present invention provides coaxial current paths to minimize switch inductance and to minimize unbalanced electromagnetic forces on the switch components. The movable bridging contact design coupled with the coaxial conductor arrangement of stationary contacts allows the switch to form both making and breaking functions with a single actuation movement. This feature also enables the time delay betewen making and breaking to be precisely controlled by switch design and operating conditions of the switch mechanism. By providing metal-to-metal sliding contact, the switch permits the passage of ultrahigh current and large accumulated amp squared-seconds ($I^2t$). The coaxial arrangement of the dump resistor with respect to the switch conductors minimizes inductance for current commutation and results in a compact switch package. When the switch is applied in an inductively driven electromagnetic launcher system, it can be used to provide a means for dissipating residual energy in the homopolar generator under normal operating conditions. By precharging a spring in the switch actuating mechanism, the switch can be actuated at any instant and therefore can be utilized to protect the homopolar generator and other system components under fault conditions.

Although the present invention has been described in terms of what is at present believed to be its preferred embodiment, it will be apparent to those skilled in the art that various changes may be made without departing from the scope of the invention. It is therefore intended that the appended claims cover such changes.

What is claimed is:

1. An electric switch comprising:

first, second and third tubular conductors, each having a substantially cylindrical internal surface, wherein said internal surfaces have substantially the same internal diameter and are positioned at spaced locations along a common axis;

a fourth tubular conductor having a cylindrical external surface with a diameter which is substantially equal to said internal diameter of the cylindrical internal surfaces of said first, second and third conductors, said fourth tubular conductor being mounted along said common axis such that said external surface is capable of making sliding electrical contact with the cylindrical internal surfaces of said first, second and third conductors, and said external surface having sufficient axial length to be capable of making electrical contact with each of said internal surfaces simultaneously;

means for moving said fourth conductor axially with respect to said first, second and third conductors; and means for electrically connecting said first, second and third conductors to an external circuit.

2. An electric switch as recited in claim 1, further comprising:

a resistor electrically connected across said first and second tubular conductors.

3. An electric switch as recited in claim 2, wherein said resistor is a tubular structure which is mounted along said common axis and positioned outside of said first tubular conductor.

4. An electric switch as recited in claim 1, further comprising:

a plurality of contact elements, at least one of said contact elements being positioned adjacent to each of said cylindrical internal surfaces.

5. An electrical switch as recited in claim 1, further comprising:

a fifth tubular conductor electrically connected between said first tubular conductor and said first terminal, said fifth tubular conductor being mounted along said common axis and positioned within said fourth tubular conductor.

6. An electrical switch as recited in claim 1, wherein said means for moving said fourth conductor comprises:

a plurality of insulated rods connected to said fourth conductor and extending in an axial direction from said fourth conductor.

7. An electrical switch as recited in claim 1 further comprising:

a pair of arc resistant contact elements positioned on opposite ends of said fourth conductor.

* * * * *